US010480146B2

(12) United States Patent
Rawlyk

(10) Patent No.: US 10,480,146 B2
(45) Date of Patent: Nov. 19, 2019

(54) HELICAL SCREW PILE ASSEMBLIES

(71) Applicant: Michael G. Rawlyk, Grasswood (CA)

(72) Inventor: Michael G. Rawlyk, Grasswood (CA)

( * ) Notice: Subject to any disclaimer, the term of this patent is extended or adjusted under 35 U.S.C. 154(b) by 0 days.

(21) Appl. No.: 15/984,056

(22) Filed: May 18, 2018

(65) Prior Publication Data

US 2019/0093300 A1 Mar. 28, 2019

(30) Foreign Application Priority Data

Sep. 28, 2017 (CA) ..... 2980619

(51) Int. Cl.

| | |
|---|---|
| ***E02D 5/56*** | (2006.01) |
| ***E02D 5/80*** | (2006.01) |
| ***E02D 7/22*** | (2006.01) |

(52) U.S. Cl.

CPC ..... *E02D 5/56* (2013.01); *E02D 5/801* (2013.01); *E02D 7/22* (2013.01)

(58) Field of Classification Search

CPC .. E02D 5/56; E02D 5/801; E02D 7/22; E02D 2200/1671; E02D 5/523; E02D 5/526; E21B 7/26; E21B 17/22

See application file for complete search history.

(56) References Cited

U.S. PATENT DOCUMENTS

| | | | | |
|---|---|---|---|---|
| 4,623,025 | A * | 11/1986 | Verstraeten | E02D 5/62 175/21 |
| 5,975,808 | A | 11/1999 | Fujita | |
| 7,018,139 | B1 * | 3/2006 | Slemons | E02D 5/56 405/231 |
| 7,736,095 | B2 | 6/2010 | Fujita | |
| 7,946,355 | B1 | 5/2011 | Kluge | |
| 2004/0076479 | A1 * | 4/2004 | Camilleri | E02D 5/56 405/252.1 |
| 2005/0074298 | A1 * | 4/2005 | Jones | E02D 5/523 405/252.1 |
| 2006/0051183 | A1 * | 3/2006 | Powell | E02D 5/801 411/386 |
| 2007/0214735 | A1 * | 9/2007 | Fujita | E02D 5/56 52/157 |
| 2013/0004243 | A1 | 1/2013 | Defrang | |
| 2016/0215470 | A1 | 7/2016 | Reusing et al. | |
| 2016/0333540 | A1 * | 11/2016 | Kaufman | E02D 5/526 |

FOREIGN PATENT DOCUMENTS

| | | |
|---|---|---|
| CA | 2542166 C | 1/2013 |
| JP | 3661863 | 6/2005 |
| JP | 4021996 | 12/2007 |
| JP | 2014156755 A | 8/2014 |

* cited by examiner

*Primary Examiner* — Carib A Oquendo
(74) *Attorney, Agent, or Firm* — Craig J. Lervick; Larkin Hoffman Daly & Lindgren, Ltd.

(57) ABSTRACT

Helical screw pile assemblies for piling and screwing into a foundation or the ground are provided. These pile assemblies comprise a disc member that mechanically engages with an elongated member causing the disc member to fasten onto the elongated member.

4 Claims, 5 Drawing Sheets

HELICAL SCREW PILE ASSEMBLIES

FIELD OF THE INVENTION

The present invention relates to helical screw pile assemblies for piling and screwing into a foundation or the ground, and more specifically to assemblies that comprise a disc member that mechanically engages with an elongated member causing the disc member to fasten onto the elongated member.

BACKGROUND

It is known in the arts of engineering and construction to employ piles that are inserted into the ground for supporting a specific structure.

Helical screw piles for piling and screwing into a foundation or the ground range in various forms, sizes, materials and shapes. Piles may be designed to suit specific applications directed to engineering and construction type projects.

Screw piles offer numerous advantages over other types of piling. For example, screw piles can be loaded without the typical delays associated with cast in place piling. Cast in place generally requires a 7-day waiting period before work may resume to validate concrete strength. Conversely, screw piling is monitored from torque values during installation. These values directly relate to load capacity of a screw pile. Once torque values are achieved, the pile can be "loaded" with no further delays.

Furthermore, as there are no tailing removal required when using helical screw piles, ground disturbance is minimal. Screw piling equipment operate at lower noise levels due to rotation of piling versus that of auger type or driven piling. A disadvantage of cast in place piling is the lack of availability and proximity of concrete to job sites at remote locations. This disadvantage is overcome by screw piling equipment since concrete is not required during use of this equipment.

Conventional screw piles comprise a shaft (or pipe) and a screw helix which is mounted onto the shaft. It should be noted, however, that the shape of the shaft or pipe is not limited to round. It can be square and/or a combination of several shapes. Helix arrangement and the number of helixes mounted on the shaft may also vary. Typically, the helix component of the pile is welded onto the shaft, for example, by metal fusion welding. For piles of this type, certified welders follow strict guidelines and quality measures to complete the manufacture of a screw pile. This can be a cumbersome, complex and costly process.

Many conventional screw piles suffer from drawbacks such as inconvenience of transportation and storage, and complexity of manufacturing due to the strict guidelines and quality measures needed for welding the components of the piles.

What is needed, therefore, are helical screw pile assemblies that can be stored and transported as unassembled components, while providing for a non-complex and rapid means to assemble the components when needed.

SUMMARY

The present invention therefore seeks to provide pile assemblies that can be mechanically assembled.

According to a broad aspect of the present invention, there is provided a pile assembly comprising:

an elongated member comprising a plurality of holes, the plurality of holes displaced helically along the surface of the elongated member; and a disc member comprising:

an outer peripheral extent and an inner peripheral extent;

a slot extending between the outer peripheral extent and the inner peripheral extent to form spaced-apart first and second ends; and a plurality of protruding elements displaced radially along the inner peripheral extent;

whereas in a first configuration, the first end and second end of the disc member are substantially coplanar with each other; and whereas in a second configuration, the first end and second end of the disc member are axially separated from each other such that the disc member forms a helical shape allowing the plurality of protruding elements to engage with the plurality of holes along the surface of the elongated member causing the disc member to fasten onto the elongated member.

Preferably, when the pile assembly is in the first configuration, the diameter of the inner peripheral extent is greater than an outer diameter of the elongated member.

As the first end and second end of the disc member are axially separated from each other, a central cavity, defined by the inner peripheral extent, is formed along a central longitudinal axis of the disc member as it is in a helical form. Preferably, when the pile assembly is in the second configuration, the diameter of the cavity defined by the inner peripheral extent is essentially the same as the outer diameter of the elongated member.

It is also preferable, when the pile assembly is in the second configuration, that the distance the first end and second end of the disc member are axially separated from each other is greater than an outer diameter of the elongated member.

The disc member may be composed of a deformable material radially biased towards the first configuration. The disc member may be composed of a deformable material axially biased towards the first configuration.

In some exemplary embodiments, the pile assembly may further comprise a removable point configured to mount to an end of the elongated member or a pointed end.

A detailed description of exemplary embodiments of the present invention is given in the following. It is to be understood, however, that the invention is not to be construed as being limited to these embodiments. The exemplary embodiments are directed to a particular application of the present invention, while it will be clear to those skilled in the art that the present invention has applicability beyond the exemplary embodiments set forth herein.

BRIEF DESCRIPTION OF THE DRAWINGS

In the accompanying drawings, which illustrate exemplary embodiments of the present invention.

Exemplary embodiments of the present invention will now be described with reference to the accompanying drawings.

DESCRIPTION

Throughout the following description, specific details are set forth in order to provide a more thorough understanding to persons skilled in the art. However, well-known elements may not have been shown or described in detail to avoid unnecessarily obscuring the disclosure. The following description of examples of the technology is not intended to be exhaustive or to limit the invention to the precise form of any exemplary embodiment. Accordingly, the description and drawings are to be regarded in an illustrative, rather than a restrictive, sense.

The present invention is directed to pile assemblies. The pile assemblies comprise an elongated member comprising a plurality of holes that are displaced helically along the surface of the elongated member. The pile assemblies also comprise a disc member that has a an outer peripheral extent and an inner peripheral extent. The disc member has a slot extending between the outer peripheral extent and the inner peripheral extent to form spaced-apart first and second ends. A plurality of protruding elements are displaced radially along the inner peripheral extent.

In a first configuration, the pile assemblies of the present invention are in a non-assembled state so the assemblies can be easily stored and transported. In this configuration, the first end and second end of the disc member are substantially coplanar with each other.

In a second configuration, the pile assemblies of the present invention are in an assembled state. In this configuration, the first end and second end of the disc member are axially separated from each other such that the disc member forms a helical shape. This allows for the plurality of protruding elements to engage with the plurality of holes along the surface of the elongated member causing the disc member to fasten onto the elongated member.

Figure 1:
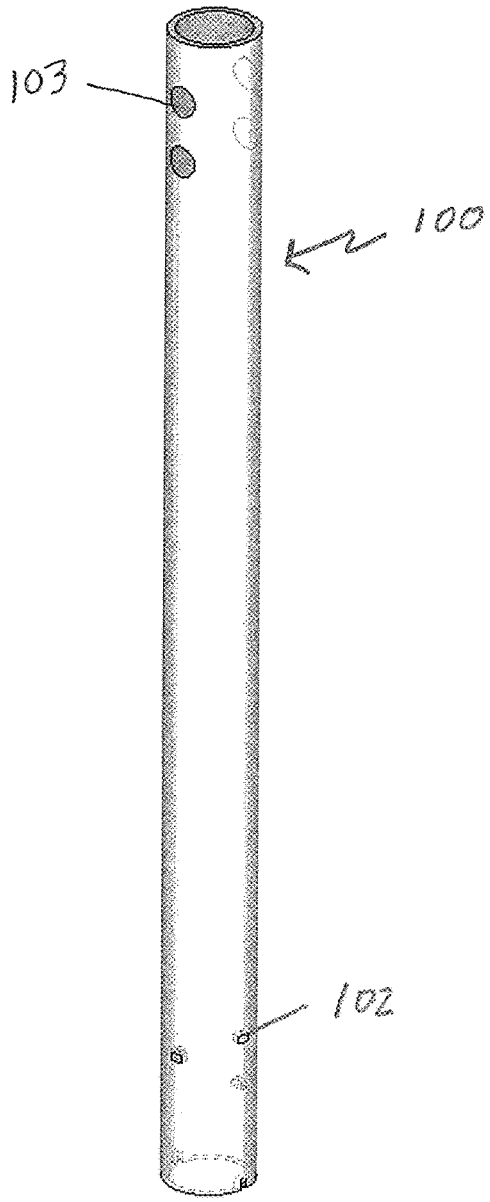
FIG. 1 is a perspective view of an elongated member of a first embodiment of the present invention.

Turning to FIG. 1, an elongated member 100 of a first embodiment of the present invention is illustrated. The elongated member 100 shown, comprises a plurality of holes 102 that are displaced helically along the surface of the elongated member 100 in the vicinity of the end of the elongated member 100 that enters the ground. The elongated member 100 may be comprised of steel material, however it may be made of other suitable materials that would be known to a person skilled in the art. Furthermore, the elongated member 100 shown is a hollow tubular member such as a pipe, however, in other exemplary embodiments of the present invention, the elongated member 100 may be a solid elongated member.

The holes 102 are positioned along the surface of the elongated member 100 in a manner to engage with the protruding elements of the disc member when the disc member is in a helical form and the pile assembly is in a second configuration (discussed below). Although, the holes 102 shown are rectangular in shape, the holes may be of any suitable shape and size that would be known to a person skilled in the art.

The elongated member 100 of the first embodiment may also comprise drive engagement holes 103 that allow the elongated member 100 to engage with a machine (not shown) configured for inserting pile assemblies into the ground. Other suitable drive engagement means could be used that would be known to a person skilled in the art.

Figure 2:
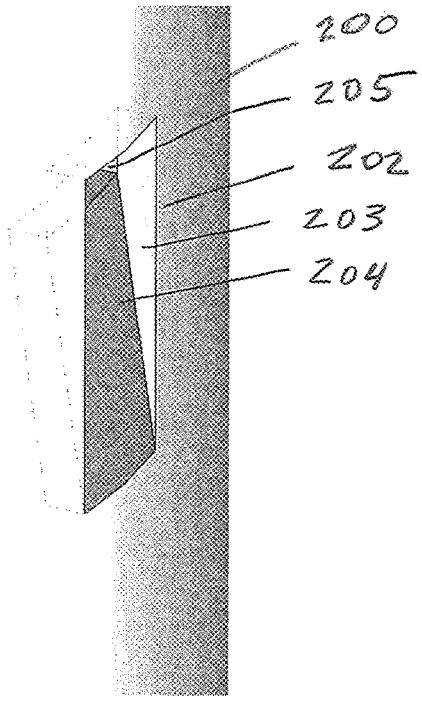
FIG. 2 is a perspective view of a slot having a flap pressed towards the inside of an elongated member of an exemplary embodiment of the present invention.

In some exemplary embodiments of the present invention, the holes 102 may be a slot 202 having a flap 204 pressed towards the inside of the elongated member, as shown in FIG. 2. This allows for the flap 204 in conjunction with at least once inner surface 203 of the slot 202 to function as a guide for engaging the protruding elements of the disc member with the slot 202, in particular, an aperture 205 within the slot 202.

Figure 3A:
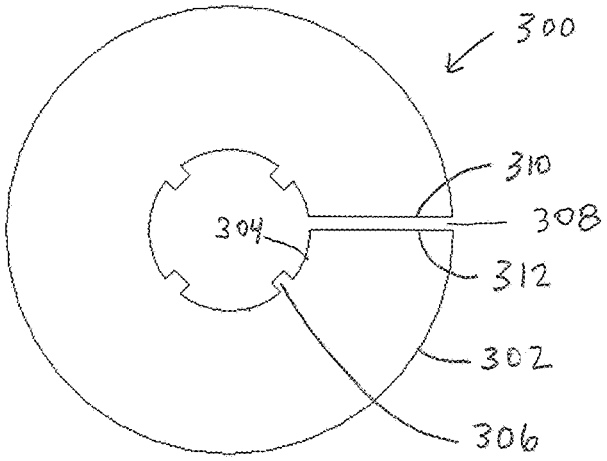
FIG. 3*a* is a top plan view of a disc member of the first embodiment of the present invention in a first configuration.

Turning to FIG. 3*a*, a disc member 300 of the first embodiment of the present invention, while in a first configuration, is illustrated. The disc member 300 shown comprises an outer peripheral extent 302 and an inner peripheral extent 304 defining an aperture substantially at the center of the disc member 300. The disc member 300 also comprises a slot 308 extending between the outer peripheral extent 302 and the inner peripheral extent 304. The slot 308 forms a spaced-apart first end 310 and second end 312 of the disc member 300. In this configuration, the first end 310 and second end 312 of the disc member 300 are substantially coplanar with each other. Along the inner peripheral extent 304, a plurality of protruding elements 306 are radially displaced.

Figure 4:
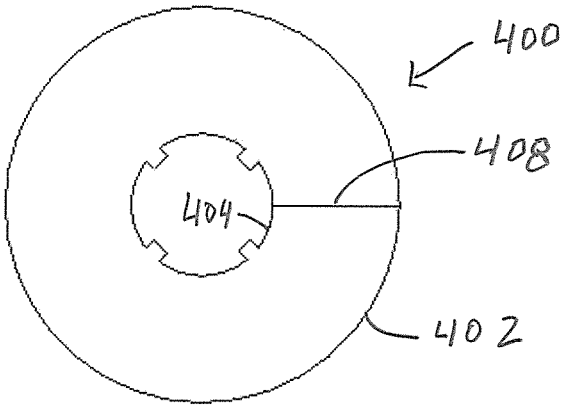
FIG. 4 is a top plan view of a disc member of an exemplary embodiment of the present invention in a first configuration.

In some exemplary embodiments of the present invention, as shown in FIG. 4, the disc member 400 comprises a cut 408 extending between the outer peripheral extent 402 and the inner peripheral extent 404, instead of the slot 308, as shown in FIG. 3*a*.

Figure 3B:
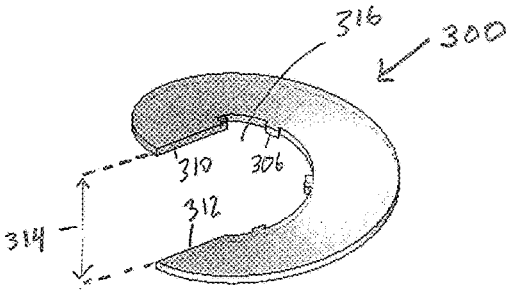
FIG. 3*b* is a top perspective view of a disc member of the first embodiment of the present invention in a second configuration.
Figure 3C:
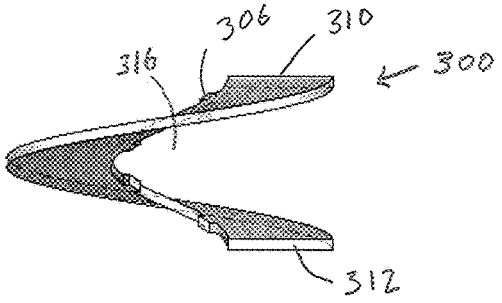
FIG. 3*c* is an elevation view of a disc member of the first embodiment of the present invention in a second configuration.

Turning to FIGS. 3*b* and 3*c*, the disc member 300 of the first embodiment of the present invention, while in a second configuration, is illustrated. In this configuration, the first end 310 and second end 312 of the disc member 300 are axially separated from each other such that the disc member 300 forms a helical shape. This allows for the plurality of protruding elements 306 to engage with the plurality of holes 102 along the surface of the elongated member 100 (shown in FIG. 1) causing the disc member 300 to fasten onto the elongated member 100. As the first end 310 and second end 312 of the disc member 300 are axially separated from each other, a central cavity 316, defined by the inner peripheral extent 304, is formed along a central longitudinal axis of the disc member 300 as it is in a helical form.

While the pile assembly is in the second configuration and the disc member 300 is in a helical form, the protruding elements 306 are positioned in a manner to engage with the holes 102 of the elongated member 100.

Preferably, when the pile assembly of the present invention is in the first configuration, the diameter of the inner peripheral extent 304 of the disc member 300 is greater than an outer diameter of the elongated member 100. This allows for the elongated member 100 to fit into the central cavity 316, defined by the inner peripheral extent 304, since the cavity defined by the inner peripheral extent 304 decreases in diameter as the disc member 300 is stretched axially and converted from a first configuration into a second configuration. When the pile assembly is in the second configuration, the diameter of the cavity 316 defined by the inner peripheral extent 304 is essentially the same as the outer diameter of the elongated member 100.

It is also preferable, although not required, when the pile assembly is in the second configuration, that the distance the first end 310 and second end 312 of the disc member 300 are axially separated from each other 314 is greater than an outer diameter of the elongated member 100. This allows for the elongated member 100 to enter the gap between the first end 310 and second end 312 of the disc member 300 when engaging and assembling both components.

The disc member 300 is preferably composed of a deformable material that is radially biased towards the first configuration. This facilitates the fastening of the disc member 300 onto the elongated member 100 as the protruding elements 306 along the inner peripheral extent 304 of the disc member 300 engages with the plurality of holes 102 along the surface of the elongated member 100.

The disc member 300 may be composed of a deformable material that is axially biased towards the first configuration. This facilitates the fastening of the disc member 300 onto the elongated member 100 as the protruding elements 306 along the inner peripheral extent 304 of the disc member 300 engages with the plurality of holes 102 along the surface of the elongated member 100.

The disc member 300 may be comprised of steel material, however it may be made of other suitable materials, known to a person skilled in the art, that allow a pile assembly of the present invention to transition from a first configuration to a second configuration. Furthermore, the protruding elements 306 along the inner peripheral extent 304 of the disc member 300 are of a suitable shape and size, known to a person skilled in the art, that would allow the elements 306 to engage with the holes 102 on the elongated member 100.

Figure 5:
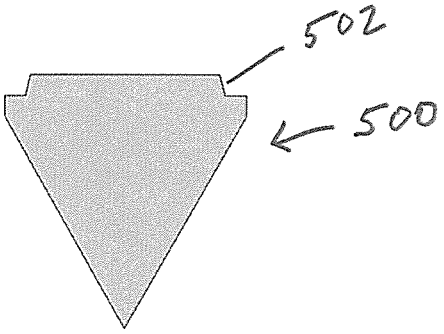
FIG. 5 is an elevation of a point of the first embodiment of the present invention.

As shown in FIG. 5, in some exemplary embodiments of the present invention, the pile assembly of the present invention may further comprise a removable point 500 configured to mount to an end of the elongated member 100. The point 500 facilitates insertion of the pile assembly into the ground. For example, the point 500 may be used for aligning the center of a pile assembly to that of a survey pin at start of inserting into the ground. The removable point 500 comprises a tapered section 502 that engages with the end of the elongated member 100 causing the point 500 to mount onto the end of the elongated member 100. The tapered section 502 acts as a wedge when you drive the point 500 into the slot of the elongated member 100. The shoulder of the tapered section stops at the slot in the pipe. Preferably, the engagement of the point 500 to the elongated member 100 uses an interference fit. Although welding is not required, but welding may be used to further secure the point 400 to the elongated member 100.

Alternatively, the elongated member 100 may have a pointed end for inserting into the ground.

Figure 6A:
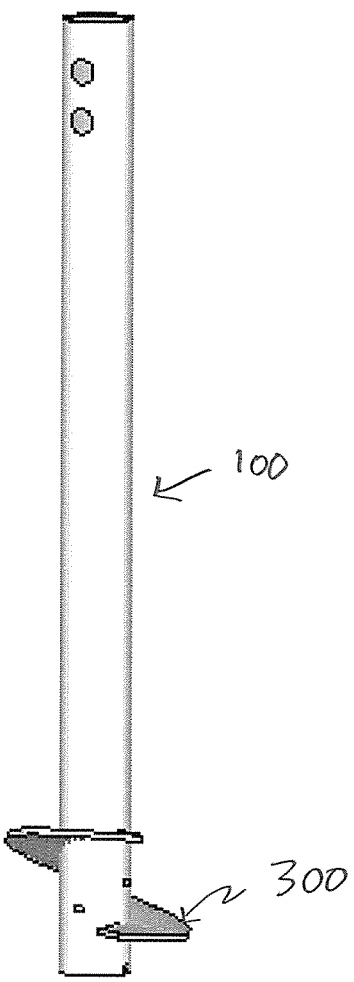
FIG. 6*a* is an elevation view of the components of the first embodiment of the present invention being assembled.
Figure 6A:
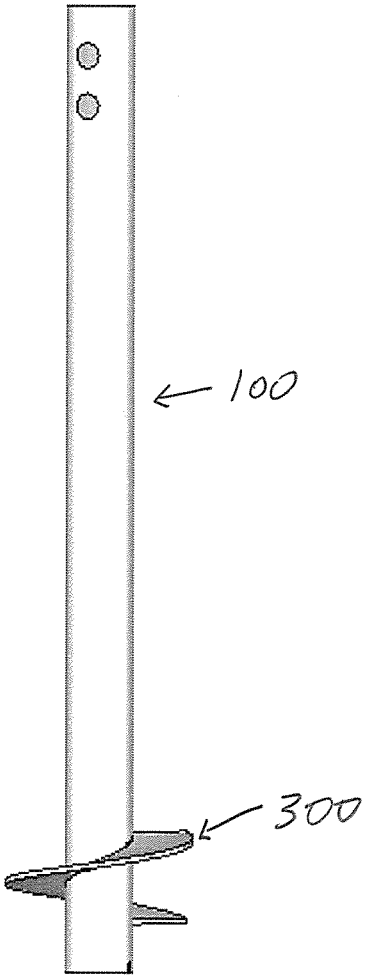
Figure 6B:
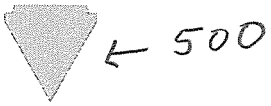
FIG. 6*b* is an elevation view of the first embodiment of the present invention being in a second configuration.

Turning to FIGS. 6*a* and 6*b*, assembly of the components of the pile assembly of the first embodiment of the present invention, is illustrated. FIG. 6*a* shows attachment of the disc member 300 to the elongated member 100. After the first end 310 and second end 312 of the disc member 300 are axially separated from each other to form a helical shaped disc member 300, the elongated member 100 is inserted into the disc member 300 while aligning the top protruding element 306 to engage with the top hole 102 on the elongated member 100. Preferably, the disc member (in helical form) 300 is held in a vise at one end to allow flexing, as the protruding elements 306 nest into the holes 102 on the elongated member. The disc member 300 is twisted and leveraged such that protruding elements 306 engage with the holes 102 on the elongated member 100. As the disc member 300 is preferably composed of a deformable material that is radially and/or axially biased towards the first configuration, it collapses around the elongated member 100 keeping the protruding elements 306 engaged with the holes 102 on the elongated member 100. Weld adhesive may be applied to the interface between the disc member 300 and elongated member 100 if required to provide added support and connection strength at the interface of the elongated member 100 and the disk member 300 (in a helical shape). A person skilled in the art would know of other suitable ways to assemble the components of the pile assembly.

FIG. 6*b* illustrates the pipe assembly of the present invention in the second configuration wherein the disc member 300 is fastened onto the elongated member 100. The point 500 shown is not fastened to the elongated member 100.

Figure 6C:
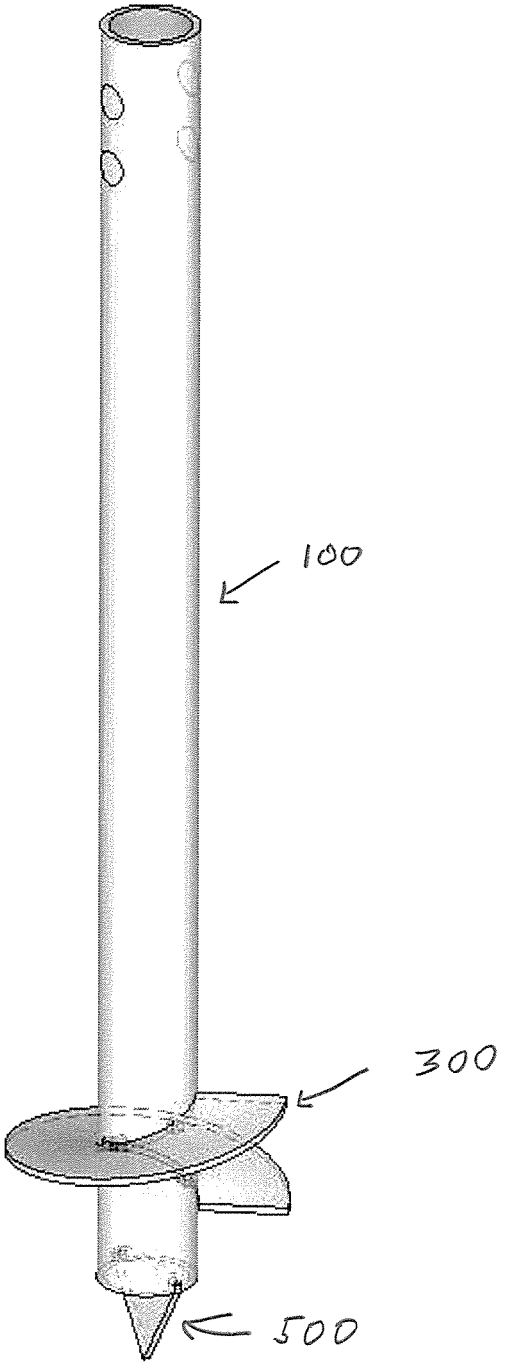
FIG. 6*c* is a perspective view of the first embodiment of the present invention being in a second configuration.

FIG. 6*c* illustrates the pipe assembly of the present invention in the second configuration wherein the disc member 300 is fastened onto the elongated member 100 and the point 500 is fastened to the elongated member 100 (as discussed above).

Unless the context clearly requires otherwise, throughout the description and the claims:

- "comprise", "comprising", and the like are to be construed in an inclusive sense, as opposed to an exclusive or exhaustive sense; that is to say, in the sense of "including, but not limited to".
- "connected", "coupled", or any variant thereof, means any connection or coupling, either direct or indirect, between two or more elements; the coupling or connection between the elements can be physical, logical, or a combination thereof
- "herein", "above", "below", and words of similar import, when used to describe this specification shall refer to this specification as a whole and not to any particular portions of this specification.
- "or", in reference to a list of two or more items, covers all of the following interpretations of the word: any of the items in the list, all of the items in the list, and any combination of the items in the list.
- the singular forms "a", "an" and "the" also include the meaning of any appropriate plural forms.

Words that indicate directions such as "vertical", "transverse", "horizontal", "upward", "downward", "forward", "backward", "inward", "outward", "vertical", "transverse", "left", "right", "front", "back", "top", "bottom", "below", "above", "under", and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component (e.g. a circuit, module, assembly, device, etc.) is referred to herein, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of methods and apparatus have been described herein for purposes of illustration. These are only examples. The technology provided herein can be applied to contexts other than the exemplary contexts described above. Many alterations, modifications, additions, omissions and permutations are possible within the practice of this invention. This invention includes variations on described embodiments that would be apparent to the skilled person, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

The foregoing is considered as illustrative only of the principles of the invention. The scope of the claims should not be limited by the exemplary embodiments set forth in the foregoing, but should be given the broadest interpretation consistent with the specification as a whole.

Various embodiments of the invention have been described above for purposes of illustrating the details thereof and to enable one of ordinary skill in the art to make and use the invention. The details and features of the disclosed embodiment[s] are not intended to be limiting, as many variations and modifications will be readily apparent to those of skill in the art. Accordingly, the scope of the present disclosure is intended to be interpreted broadly and to include all variations and modifications coming within the scope and spirit of the appended claims and their legal equivalents.

The invention claimed is:

1. A method for assembling a pile comprising a disc member comprising an outer peripheral extent and an inner peripheral extent and a slot extending between the outer peripheral extent and the inner peripheral extent to form spaced-apart first and second ends, the method comprising the steps of:

axially separating the first end and the second end of the disc member allowing the disc member to form a helical shape having a central cavity defined by the inner peripheral extent;

providing an elongated member and positioning the elongated member longitudinally within the central cavity;

engaging the inner peripheral extent of the disc member with the elongated member;

fastening the disc member onto the elongated member; and inserting each of a plurality of protruding elements displaced radially along the inner peripheral extent into one of a plurality of holes displaced helically along an outer surface of the elongated member.

2. The method of claim 1 wherein the step of fastening comprises allowing the disc member to bias axially inwardly when each of the plurality of protruding elements displaced radially along the inner peripheral extent are inserted into one of the plurality of holes displaced helically along the surface of the elongated member.

3. The method of claim 1 wherein the step of fastening comprises allowing the disc member to bias radially inwardly when each of the plurality of protruding elements displaced radially along the inner peripheral extent are inserted into one of the plurality of holes displaced helically along the surface of the elongated member.

4. The method of claim 1 wherein a distance the first end and second end of the disc member are axially separated from each other is greater than an outer diameter of the elongated member.

* * * * *